US005274305A

United States Patent [19]

Bouchard

[11] Patent Number: 5,274,305

[45] Date of Patent: Dec. 28, 1993

[54] LOW PRESSURE MERCURY DISCHARGE LAMP WITH THERMOSTATIC CONTROL OF MERCURY VAPOR PRESSURE

[75] Inventor: Andre C. Bouchard, Peabody, Mass.

[73] Assignee: GTE Products Corporation, Danvers, Mass.

[21] Appl. No.: 802,100

[22] Filed: Dec. 4, 1991

[51] Int. Cl.[5] ..... H01J 13/28

[52] U.S. Cl. ..... 315/108; 315/117

[58] Field of Search ..... 315/109, 108, 46, 47, 315/73, 115–117, 71; 313/13, 15, 43, 550, 556

[56] References Cited

U.S. PATENT DOCUMENTS

| | | | |
|---|---|---|---|
| 1,908,649 | 5/1933 | Spaeth | 315/109 |
| 1,930,148 | 10/1933 | Pirani | 315/108 |
| 2,103,039 | 12/1937 | Pirani | 315/108 |
| 2,110,690 | 3/1938 | Zierahn | 315/71 |
| 2,191,507 | 2/1940 | Spanner | 315/108 |
| 2,280,550 | 4/1942 | Smitley | 315/73 |
| 3,742,278 | 6/1973 | Shindelman et al. | 313/109 |
| 3,935,463 | 1/1976 | Jacobson | 250/373 |
| 4,459,513 | 7/1984 | Frey | 315/108 |
| 4,481,442 | 2/1982 | Albrecht | 313/493 |
| 4,694,215 | 9/1987 | Hofmann | 313/44 |
| 4,823,047 | 4/1989 | Holmes | 313/546 |
| 4,827,313 | 5/1989 | Corona | 355/30 |
| 4,931,685 | 6/1990 | Dobashi et al. | 313/15 |
| 4,972,118 | 11/1990 | Yorifuji | 313/550 |

*Primary Examiner*—Eugene R. LaRoche
*Assistant Examiner*—A. Zarabian
*Attorney, Agent, or Firm*—Carlo S. Bessone

[57] ABSTRACT

The mercury vapor pressure in a low pressure mercury discharge lamp is thermostatically controlled. A low pressure mercury discharge lamp includes electrodes and a source of mercury vapor sealed in a lamp envelope. A heater and a thermal switching device are in thermal contact with the source of mercury vapor. The heater is energized when the source of mercury vapor is below a predetermined temperature during operation of the lamp. The heater is preferably a resistance heater electrically connected in series with one of the lamp electrodes. The thermal switching device can be a bimetal thermostatic switch. The source of mercury vapor is typically an amalgam selected to have an optimum mercury vapor pressure at the maximum operating temperature of the lamp. The heater and the thermal switching device can be located external to the lamp envelope or can be located within the lamp envelope. The lamp provides a relatively constant light output over a broad range of operating temperatures and different lamp orientations.

18 Claims, 2 Drawing Sheets

LOW PRESSURE MERCURY DISCHARGE LAMP WITH THERMOSTATIC CONTROL OF MERCURY VAPOR PRESSURE

CROSS-REFERENCE TO A RELATED APPLICATION

This application discloses, but does not claim, inventions which are claimed in U.S. Ser. No. 07/802,117 filed concurrently herewith and assigned to the Assignee of this application.

FIELD OF THE INVENTION

This invention relates to low pressure mercury discharge lamps such as fluorescent lamps and, more particularly, to fluorescent lamps having thermostatic control of mercury vapor pressure so that the light output of the lamp is substantially constant for a broad range of ambient temperatures and for different lamp orientations.

BACKGROUND OF THE INVENTION

Low pressure mercury discharge lamps, such as fluorescent lamps, rely upon mercury vapor for producing a discharge. The lumen output of such lamps is a function of mercury vapor pressure, which, in turn, generally depends on the cold spot temperature of the lamp envelope. It is well known to those skilled in the art that the cold spot temperature for most efficient lamp operation is approximately 40° C., which produces a mercury vapor pressure of approximately $4\text{–}6\times^{-3}$ torr inside the lamp envelope. Due to high lamp loading and high ambient temperatures, the lamp envelope temperature and mercury vapor pressure are frequently above the optimum value. For nonoptimum mercury pressures, the light output of the lamp may decrease significantly. One known method for regulating mercury vapor pressure at high ambient temperatures or high wall temperatures is to use an amalgam. In addition to reducing the mercury vapor pressure at high temperatures, the amalgam produces a stable mercury pressure over a broader temperature range. The use of an amalgam in low pressure mercury vapor lamps is disclosed, for example, in U.S. Pat. No. 3,742,278 issued Jun. 26, 1973 to Shindelman et al.

The stabilization of mercury vapor pressure over a broad temperature range provided by an amalgam is frequently inadequate to encompass many typical operating conditions. For example, a lamp with an amalgam that is designed to operate efficiently under adverse conditions, such as in unventilated enclosed fixtures, may not operate efficiently at normal ambient temperatures, and the light output may be reduced by 20% or more. A result of the limited temperature range of amalgams is that different lamps with different amalgams are required for different applications, depending on the expected operating temperature.

The light output of low pressure mercury discharge lamps, such as compact fluorescent lamps, is sensitive to lamp orientation. It has been demonstrated in one instance, for example, that a 26 watt double twin tube amalgam-containing compact fluorescent lamp manufactured by GTE Products Corporation, when operated in a base up mode, has a more uniform light output over a broader ambient temperature range than the same lamp operated in a horizontal mode. It has been determined, for instance in this case, that the amalgam located in the base of the lamp has an operating temperature 40° C. higher in a base up orientation due to heat convection. This higher temperature coincides with a more ideal mercury vapor pressure above the amalgam than when the lamp is operated in a horizontal orientation. Thus, the amalgam operates at a more optimum temperature in the base up mode. Since the light output for both amalgam and non-amalgam lamps is sensitive to lamp orientation, the user must specify the lamp orientation to obtain a lamp having the maximum light output. Alternatively, the lamp is used in a nonoptimum orientation, and the light output is reduced.

Since fluorescent lamps have a limited operating temperature range and are sensitive to orientation, it has been necessary to design different lamps for different applications. This is inefficient in terms of manufacturing, inventory and sales, and adds to the cost of fluorescent lamps.

Techniques for controlling mercury vapor pressure in low pressure mercury discharge lamps have been disclosed in the prior art. A sleeve-type heater for an aperture fluorescent lamp used in a photocopier is disclosed in U.S. Pat. No. 4,827,313 issued May 2, 1989 to Corona. A film heater for a discharge lamp used for back lighting of crystal displays is disclosed in U.S. Pat. No. 4,931,685 issued Jun. 5, 1990 to Dobashi et al. A compact fluorescent lamp wherein mercury vapor pressure is controlled by controlling the flow of cooling air around the lamp is disclosed in U.S. Pat. No. 4,694,215 issued Sep. 15, 1987 to Hofman. All of the known prior art techniques for controlling mercury vapor pressure in low pressure mercury discharge lamps have had one or more disadvantages, including blockage of light output by film or sleeve type heaters and complexities in circuit designs, which add substantial costs.

It is a general object of the present invention to provide improved low pressure mercury discharge lamps.

It is another object of the present invention to provide low pressure mercury discharge lamps wherein the light output level is substantially constant over a broader range of ambient temperatures.

It is a further object of the present invention to provide low pressure mercury discharge lamps wherein the light output level is substantially constant for different lamp orientations.

It is a yet another object of the present invention to provide low pressure mercury discharge lamps wherein mercury vapor pressure is thermostatically controlled, with negligible blockage of light emitted from the lamp.

It is still another object of the present invention to provide low pressure mercury discharge lamps wherein the temperature of an amalgam located in an exhaust tubulation is thermostatically controlled.

SUMMARY OF THE INVENTION

According to the present invention, these and other objects and advantages are achieved in a low pressure mercury discharge lamp comprising a lamp envelope having electrodes and a source of mercury vapor sealed therein, heating means in thermal contact with the source of mercury vapor, and thermal switching means for applying electrical energy to the heating means when the source of mercury vapor is below a predetermined temperature during operation of the lamp. The source of mercury vapor is preferably located at a cold spot in the lamp envelope. The lamp envelope emits light over substantially its entire surface when the electrodes are energized by electrical energy. The heating means and the thermal switching means are dimensioned and located for negligible blockage of light emitted from the lamp envelope.

The source of mercury vapor preferably comprises an amalgam or pure mercury. The heating means preferably comprises a resistance heater. The resistance heater can be electrically connected in series with one of the electrodes. The thermal switching means preferably comprises a bimetal thermostatic switch. The bimetal thermostatic switch can be electrically connected in parallel with the heating means. The bimetal switch closes and the heating means is deenergized when the source of mercury vapor is above the predetermined optimum temperature.

In a first embodiment of the invention, the source of mercury vapor is located in an exhaust tubulation of the lamp envelope, and the heating means and the thermal switching means are in thermal contact with the exhaust tubulation. In a preferred embodiment, the heating means comprises a resistance wire wrapped around the exhaust tubulation adjacent to the source of mercury vapor, and the thermal switching means comprises a bimetal thermostatic switch in thermal contact with the exhaust tubulation.

In a second embodiment of the invention, the source of mercury vapor is located in a capsule within the lamp envelope, and the heating means and the thermal switching means are in thermal contact with the capsule. In a preferred embodiment, the capsule is fabricated of a heat absorbing material to accelerate the heating of the latter and includes an opening to permit passage of mercury vapor.

The heating means and the thermal switching means can be located external to the lamp envelope or can be located within the lamp envelope. The predetermined optimum temperature is preferably selected such that the light output of the lamp envelope is substantially constant over a range of ambient temperatures and lamp orientations. In a preferred amalgam lamp embodiment, an amalgam is preferably chosen of a composition such that its optimum mercury pressure is at a temperature at or near the maximum temperature it will encounter during lamp life.

According to another aspect of the invention, there is provided a method for operating a low pressure mercury discharge lamp including a lamp envelope having electrodes and an amalgam sealed therein. The method comprises the steps of energizing the low pressure mercury discharge lamp with electrical energy such that light is emitted from substantially the entire surface of the lamp envelope, and sensing the temperature of the amalgam and heating the amalgam when the amalgam is below a predetermined temperature and the low pressure mercury discharge lamp is energized. The steps of sensing the temperature of the amalgam and heating the amalgam are performed so as to produce negligible blockage of light.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
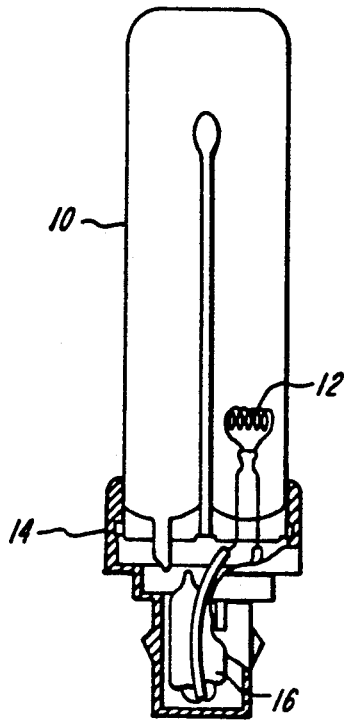
FIG. 1 is an elevation view, partially in cross section, of a compact fluorescent lamp suitable for incorporation of the present invention.

A compact fluorescent lamp is shown in FIG. 1. A tubular, generally U-shaped lamp envelope 10 is coated on its inside surface with a phosphor coating. Electrodes 12 are mounted at opposite ends of the lamp envelope, and mercury or an amalgam is contained within the lamp envelope 10. The lamp envelope 10 is mounted in a base 14 which contains a lamp starter 16. An example of a compact fluorescent lamp of the type shown is a 26 watt Double Twin Tube Compact Fluorescent Lamp, manufactured and sold by GTE Products Corporation.

When electrical energy is applied to the lamp, a discharge within the lamp envelope emits ultraviolet radiation. The ultraviolet radiation stimulates emission of visible light from the phosphor coating on the inside surface of lamp envelope 10. The lamp starter 16 applies electrical current for heating the electrodes until a discharge is established in the lamp envelope 10.

Figure 2:
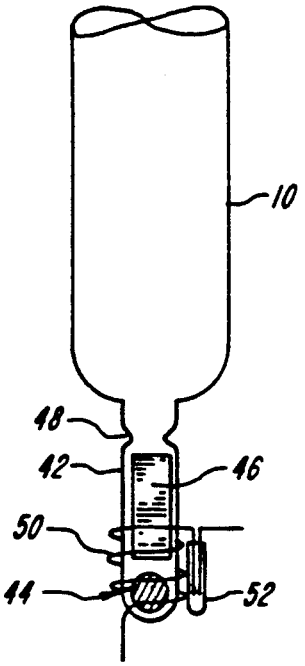
FIG. 2 illustrates an exhaust tubulation of the compact fluorescent lamp having a heater and a thermostatic switch mounted thereon for controlling mercury vapor pressure in accordance with the present invention.

A partial view of one tube of the compact fluorescent lamp is shown in FIG. 2. The compact fluorescent lamp of FIG. 1 has been modified in accordance with the present invention. The lamp envelope 10 includes an exhaust tube 42 that is used to hold an amalgam 44. The amalgam 44 is positioned in tube 42 and is retained within the tube by a glass plug 46. Sufficient clearance is provided between glass plug 46 and the inside surface of exhaust tube 42 to permit passage of mercury vapor from amalgam 44, while preventing the solid or liquid state of the amalgam 44 from entering the main portion of lamp envelope 10. The glass plug 46 and amalgam 44 are retained in exhaust tube 42 at one end by a pinched region 48 of exhaust tube 42. The tube 42 is sealed at the other end beyond the amalgam prior to exhausting the lamp from a secondary exhaust tube not shown in FIG. 1. Techniques for fabrication of the compact fluorescent lamp with the amalgam 44 located in exhaust tube 42 are known to those skilled in the art.

In accordance with the present invention, the compact fluorescent lamp is provided with means for controlling the temperature of the amalgam 44 and therefore controlling the mercury vapor pressure within lamp envelope 10. The temperature control means generally includes a heater and a thermal switching device for controlling operation of the heater. The thermal switching device causes the heater to be energized when the amalgam temperature is below a predetermined temperature.

Referring again to FIG. 2, a heater 50 preferably comprises a resistance wire wrapped around the outside of exhaust tube 42 adjacent to the region where amalgam 44 is located. A miniature thermostatic switch 52 is affixed to the exhaust tube 42 adjacent to amalgam 44. The heater 50 and the thermostatic switch 52 are in thermal contact with exhaust tube 42 and amalgam 44. A thermally-conductive compound, such as Type 44 Heat Sink Compound available from GW Electronics, Rockford, Illinois, can be used to insure thermal contact between these elements. In a preferred embodiment, the thermostatic switch 52 is a normally open bimetal switch that was modified from an existing normally closed bimetal switch called a Super Saver+switch available from GTE Products Corporation, and the heater 50 is an approximate 3 inch length of Kanthal A-1 resistance wire obtained from Kanthal Corp. Bethel, Conn. The heater 50 and the thermostatic switch 52 can be mechanically attached to exhaust tube 42 by any convenient technique such as friction.

The amalgam 44 is preferably selected of a composition such that its optimum mercury pressure occurs at or near the maximum temperature to which the amalgam is subjected during lamp operation. For example, if the amalgam temperature in the base of the compact fluorescent lamp reaches a temperature of 120° C. in a worse case condition, an alloy mercury combination is chosen to maximize the light output at these conditions. Suitable amalgam compositions are known to those skilled in the art. The thermostatic switch 52 is selected to energize the heater 50 at temperatures below about 120° C. and to deenergize the heater at temperatures above about 120° C., thereby maintaining amalgam 44 at an optimum temperature.

Figure 3:
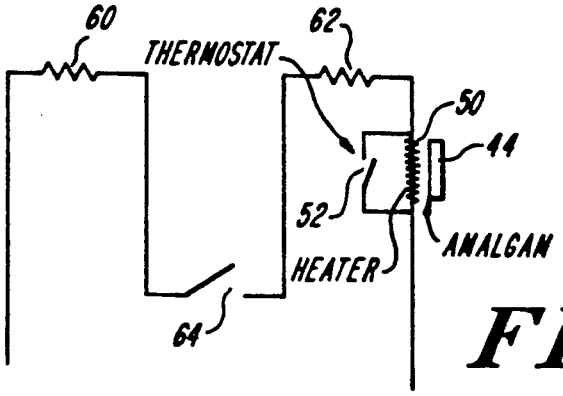
FIG. 3 is a schematic diagram showing the electrical connections of the heater and thermostatic switch in the lamp circuit of FIG. 2.

A preferred electrical circuit is shown in FIG. 3. Lamp electrodes 60 and 62, and lamp starter 64 are electrically connected in series. Heater 50 is electrically connected in series with electrode 62, and thermostatic switch 52 is connected in parallel with heater 50.

The operation of the circuit shown in FIG. 3 is as follows. Prior to application of electrical power, the lamp starter 64 is closed, and thermostatic switch 52 is open. Upon application of power, current flows through electrodes 60 and 62, lamp starter 64 and heater 50. When electrodes 60 and 62 are heated, lamp starter 64 opens, thereby causing a discharge to occur in the lamp.

The heater 50 remains energized by the discharge current after lamp starter 64 opens (if thermostatic switch 52 is still open), causing the amalgam 44 and the thermostatic switch 52 to rise in temperature. As indicated above, the closure temperature of the thermostatic switch 52 is the temperature at which optimum mercury vapor pressure is obtained. When the optimum mercury vapor pressure of the amalgam is reached, the thermostatic switch 52 closes and the heater 50 is bypassed. When the lamp does not generate sufficient heat to maintain the amalgam at the optimum operating temperature, the thermostatic switch 52 opens and allows the heater 50 to maintain the preferred operating temperature regardless of lamp orientation or ambient temperature. An additional advantage of the present invention is that the heater 50 causes the amalgam 44 to reach the optimum operating temperature more quickly than would occur without auxiliary heating of the amalgam 44.

Figure 4:
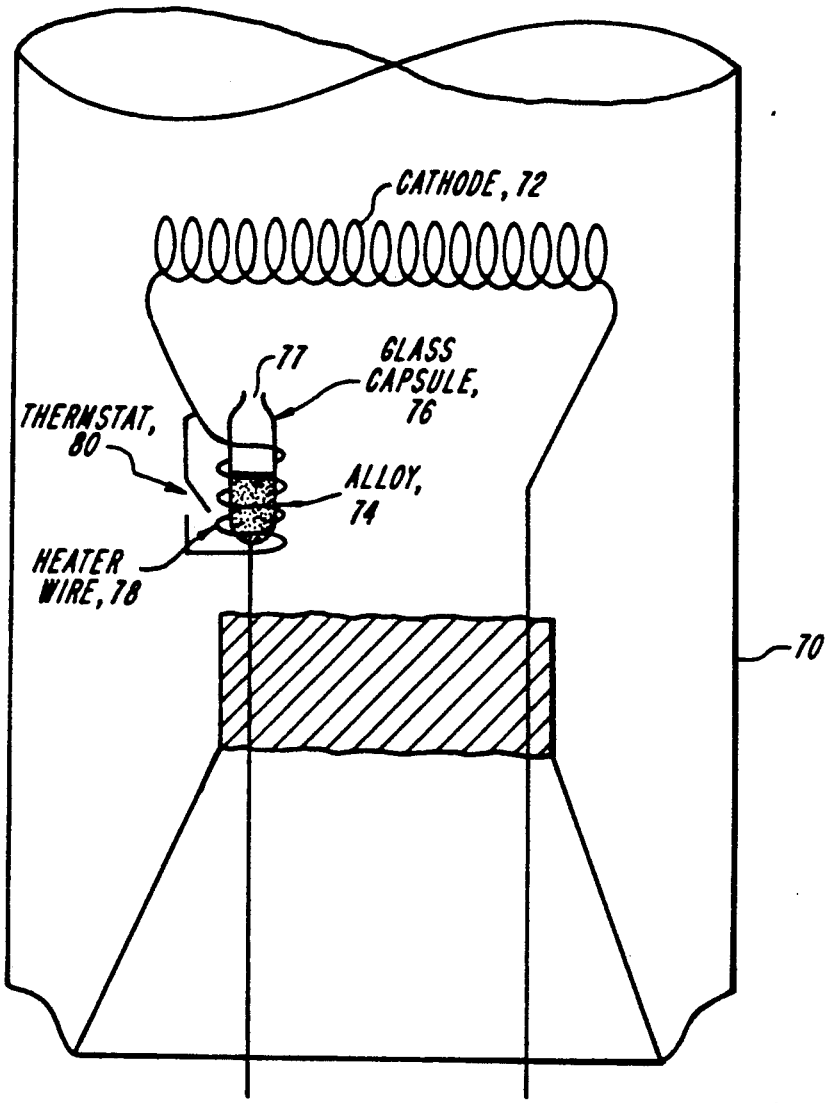
FIG. 4 illustrates one end of a conventional fluorescent lamp including a heater and thermostatic switch for controlling mercury vapor pressure in accordance with the present invention.

The present invention can be utilized in a conventional straight tube fluorescent lamp. One end of a conventional fluorescent lamp is illustrated in FIG. 4. A tubular lamp envelope 70 has an electrode 72 mounted therein. An amalgam 74 is contained in a capsule 76. The capsule 76 is typically made of a heat absorbing glass or a metal such as a nickel iron alloy. The capsule 76 includes an opening 77 to permit escape of mercury vapor generated by amalgam 74, while retaining amalgam 74. A heater 78, typically a resistance wire, is wrapped around capsule 76, and a thermostatic switch 80 is mounted in thermal contact with capsule 76. Amalgam 74, capsule 76, heater 78 and switch 80 are in intimate thermal contact. The electrical connections of the heater 78 and the thermostatic switch 80 can be as illustrated in FIG. 3 and described above.

The opening 77 in capsule 76 is constricted so as to prevent the amalgam from escaping during the lamp exhaust process. The location of capsule 76 is selected to insure that during steady state operation at the maximum fixture temperature, the amalgam 74 has an optimum mercury vapor pressure.

The operation of the heater 78 and thermostatic switch 80 is the same as described above in connection with FIG. 3. When the lamp is placed in a hot environment or fixture, the heater 78 is deenergized, thereby providing maximum light output from the lamp. When the lamp is operated in a cooler environment, the heater 78 is energized so that the light output from the lamp is maximized.

Figure 5:
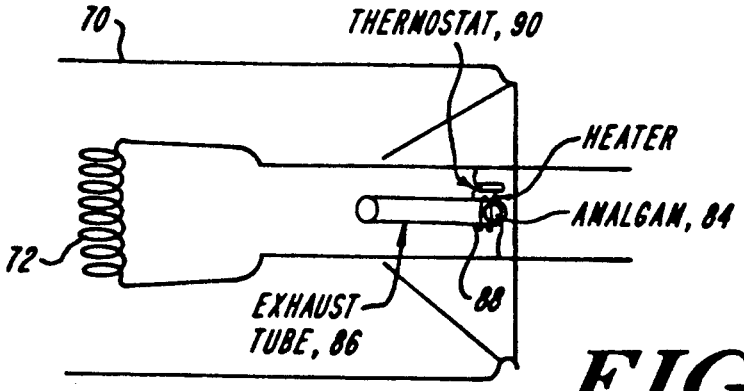
FIG. 5 shows one end of the conventional fluorescent lamp having a heater and thermostatic switch attached to the exhaust tube for controlling mercury vapor pressure in accordance with the present invention.

An alternative configuration of the conventional straight tube fluorescent lamp is shown in FIG. 5. An amalgam 84 is located in an exhaust tube 86. A heater 88 comprising a resistance wire is wrapped around exhaust tube 86 adjacent to amalgam 84, and a thermostatic switch 90 is affixed to the outside surface of exhaust tube 86 adjacent to amalgam 84. The amalgam 84, exhaust tube 86, heater 88 and thermostatic switch 90 are in intimate thermal contact. The heater 88 and thermostatic switch 90 can be electrically connected as shown in FIG. 3.

For proper operation of the invention, the vapor pressure of mercury at the control point should always remain equal to or lower than the mercury vapor pressure at any other point within the lamp. This generally corresponds to the conventional practice of placing the amalgam at the cold spot within the lamp envelope.

It will be understood that the present invention is not limited to the use of a resistance wire heater. Any suitable heating device can be used. For example, a low wattage electronic chip can be utilized to heat the amalgam. In addition, any suitable thermal switching device, such as an electronic switching circuit, can be utilized for controlling the heater. Furthermore, the present invention is not limited to the circuit shown in FIG. 3. For example, the thermostatic switch can be connected in series with the heater. In this case, the thermostatic switch is selected to close at temperatures below the predetermined temperature. The invention is not limited as to the type of low pressure mercury discharge lamp or the technique for introducing mercury into the lamp. Thus, an amalgam or pure mercury can be utilized. The present invention may use starter flags, as known in the industry, near the cathodes for amalgam type lamps to further accelerate the warm up time of the lamp.

The present invention provides a low pressure mercury discharge lamp, such as compact or standard fluorescent lamp, that can be used in a wider variety of operating conditions than prior art lamps. The mercury vapor pressure is relatively constant over a broad range of operating temperatures and different lamp orientations. As a result, the light output is relatively constant under a wide variety of operating conditions. The variation of light output from compact fluorescent lamps for different lamp orientations is reduced or eliminated in accordance with the present invention.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A low pressure mercury discharge lamp comprising:

a lamp envelope having electrodes and a source of mercury vapor sealed therein, said source of mercury vapor being located at a control point in an exhaust tubulation of said lamp envelope, said lamp envelope emitting light over substantially its entire surface when said electrodes are energized by electrical energy;

heating means in thermal contact with said source of mercury vapor; and thermal switching means located adjacent to and in thermal contact with said exhaust tubulation for applying electrical energy to said heating means when said source of mercury vapor is below a predetermined temperature during operation of said lamp, said heating means and said thermal switching means being dimensioned and located for negligible blockage of light emitted from said lamp envelope.

2. A low pressure mercury discharge lamp as defined in claim 1 wherein said source of mercury vapor comprises an amalgam.

3. A low pressure mercury discharge lamp as defined in claim 1 wherein said source of mercury vapor comprises pure mercury.

4. A low pressure mercury discharge lamp as defined in claim 1 wherein said heating means comprises a resistance wire.

5. A low pressure mercury discharge lamp as defined in claim 1 wherein said heating means is electrically connected in series with one of said electrodes.

6. A low pressure mercury discharge lamp as defined in claim 1 wherein said thermal switching means comprises a bimetal thermostatic switch.

7. A low pressure mercury discharge lamp as defined in claim 6 wherein said bimetal thermostatic switch is electrically connected in parallel with said heating means such that said heating means is deenergized when said source of mercury vapor is above said predetermined temperature.

8. A low pressure mercury discharge lamp as defined in claim 1 wherein said lamp envelope comprises a generally U-shaped tube.

9. A low pressure mercury discharge lamp as defined in claim 1 wherein said lamp envelope comprises a generally straight tube having said electrodes mounted in opposite ends thereof.

10. A low pressure mercury discharge lamp as defined in claim 1 wherein said predetermined temperature is approximately the maximum operating temperature of said lamp.

11. A low pressure mercury discharge lamp as defined in claim 1 wherein said heating means and said thermal switching means are located external to said lamp envelope.

12. A low pressure mercury discharge lamp as defined in claim 1 wherein said predetermined temperature is selected such the light output of said lamp envelope is approximately constant over a range of ambient temperatures and orientations of said lamp envelope.

13. A low pressure mercury discharge lamp as defined in claim 1 wherein said heating means comprises a resistance wire wrapped around the exhaust tubulation adjacent to the source of mercury vapor, and said thermal switching means comprises a bimetal thermostatic switch.

14. A low pressure mercury discharge lamp comprising:

a lamp envelope having electrodes and a source of mercury vapor sealed therein, said source of mercury vapor is below a predetermined temperature during operation of said lamp, said heating means and said thermal switching means being dimensioned and located for negligible blockage of light emitted from said lamp envelope.

15. A low pressure mercury discharge lamp as defined in claim 14 wherein said capsule is fabricated of heat absorbing material and includes an opening to permit passage of mercury vapor.

16. A method of operating a low pressure mercury discharge lamp including a lamp envelope having electrodes and an amalgam sealed therein, said method comprising the steps of:

energizing said low pressure mercury discharge lamp with electrical energy such that light is emitted from substantially the entire surface of said lamp envelope; and sensing the temperature of said amalgam and heating said amalgam when said amalgam is below a predetermined temperature during the step of energizing said low pressure mercury discharge lamp, the steps of sensing the temperature of said amalgam and heating said amalgam being performed with negligible blockage of light emitted from said lamp envelope.

17. A method for operating a low pressure mercury discharge lamp as defined in claim 16 wherein the step of heating said amalgam is performed by a resistance heater in thermal contact with said amalgam and wherein the step of sensing the temperature of said amalgam is performed by a thermostatic switch in thermal contact with said amalgam.

18. A method for operating a low pressure mercury discharge lamp as defined in claim 17 wherein said amalgam is located in an exhaust tubulation of said lamp envelope and wherein said resistance heater and said thermostatic switch are attached to said exhaust tubulation external to said lamp envelope.

* * * * *